United States Patent [19]
Billard et al.
[11] 4,454,816
[45] Jun. 19, 1984

[54] CARTRIDGE HAVING A PYROTECHNICAL ACTUATION OF A PAYLOAD WITH A SAFETY DEVICE

[75] Inventors: Alain A. A. Billard, Muret; Hubert C. G. Calmettes, Toulouse; Roland C. Encoyand, Muret, all of France

[73] Assignee: Societe E. Lacroix-Tous Artifices, Muret, France

[21] Appl. No.: 300,264

[22] Filed: Sep. 8, 1981

[30] Foreign Application Priority Data

Sep. 12, 1980 [FR] France ..... 80 19720

[51] Int. Cl.[3] ..... F42B 4/26

[52] U.S. Cl. ..... 102/430; 102/223; 102/251; 102/334; 102/342; 102/505

[58] Field of Search ..... 102/202.13, 222, 233, 102/235, 430, 234, 340, 367–368, 370, 513, 342, 351, 357, 505, 334

[56] References Cited

U.S. PATENT DOCUMENTS

| | | | |
|---|---|---|---|
| 1,806,877 | 5/1931 | Hale | 102/235 |
| 1,842,467 | 1/1932 | Woodberry | 102/235 |
| 2,993,648 | 7/1961 | Blackwell | 102/367 X |
| 3,712,224 | 1/1973 | Hanzel | 102/342 |
| 3,736,876 | 6/1973 | Little et al. | 102/439 |
| 3,777,666 | 12/1973 | Morel | 102/233 |
| 4,007,690 | 2/1977 | Wildridge | 102/513 |
| 4,090,450 | 5/1978 | Nygards | 102/254 |

FOREIGN PATENT DOCUMENTS

| | | | |
|---|---|---|---|
| 1534134 | 11/1978 | United Kingdom | 102/367 |

*Primary Examiner*—Harold J. Tudor
*Assistant Examiner*—Tyrone Davis
*Attorney, Agent, or Firm*—Robbins & Laramie

[57] ABSTRACT

This invention relates to the safety of ammunitions.

The projectile of a cartridge has a base which houses a safety stop consisting of a transversely slidable valve. A device ensures that the valve cannot be released until the projectile has been subjected to a powerful acceleration. Another safety device very advantageously ensures that the pyrotechnical chain inserted in the base functions only when the pressure of the ejection charge has been able to release a sealing-block.

In particular, the invention may be applied to infra red window releasing cartridges.

9 Claims, 6 Drawing Figures

CARTRIDGE HAVING A PYROTECHNICAL ACTUATION OF A PAYLOAD WITH A SAFETY DEVICE

Background of the invention

The present invention relates to the safety of ammunitions.

Cartridges comprising a tube, the casing base of which houses a pyrotechnical ejection charge, are frequently used for releasing various payloads, such as flares for example. The projectile situated in front of the ejection charge is in turn equipped with a delayed action pyrotechnical chain. Activated by the ejection charge, this pyrotechnical chain finally ignites the actuating charge of the projectile after leaving the tube.

In French Pat. No. 74 41205, the Applicant has already described the interposition of a transversely sliding valve which does not move into the ignition relay position until the projectile tube has left. The payload charge therefore cannot be actuated until the projectile has left the cartridge tube. This device, which has been widely used, now provides a significant measure of safety. Nevertheless, the present day trend is in the direction of considerably increasing the safety factor. This is accompanied by a corresponding increase in the complexity of the devices used.

BRIEF SUMMARY OF THE INVENTION

The present invention by contrast proposes a particularly satisfactory solution which is based on simple means and provides complete satisfaction, using, in addition to the above mentioned chain breaking slide valve, a double safety arrangement made up of completely separate parts and functioning on radically different principles.

In the first safety arrangement proposed, the above mentioned slide valve is fixed in the chain breaking position by a stop, held axially until subjected to a predetermined stress intensity, and attached to an inertia block which displaces it under the effect of the acceleration due to the firing of the shot.

To provide the second safety factor, which is very advantageous to use according to the invention, the pyrotechnical chain comprises in addition another chain breaker provided by interposition of a sealing-block which is also held axially below a predetermined stress and is capable of being driven out by the pressure of combustion gas. This other chain breaker is preferably placed between the ejection charge and the beginning of the delayed action pyrotechnical chain.

More particularly it may be provided by the fact that the block, which is slidable in a bore, has a shoulder accommodating a toroidal seal which is larger than the bore and abuts against it in the position where the block breaks the chain when the pressure of the gas forces the block with its seal into the bore.

In one particular embodiment, the stop is advantageously held in a position of immobilising the slide valve by a toothed washer or a thin plate capable of yielding under a predetermined force.

According to another feature of the invention, the pressure of the gas acting on the sealing-block displaces the block axially in the opposite direction to the axial movement of the inertia block due to the acceleration caused by the firing of the shot.

Other features and advantages of the invention will be apparent from the detailed description given below with reference to the attached drawings illustrating by way of a non-limiting example a preferred embodiment of the present invention.

DETAILED DESCRIPTION

Figure 1:
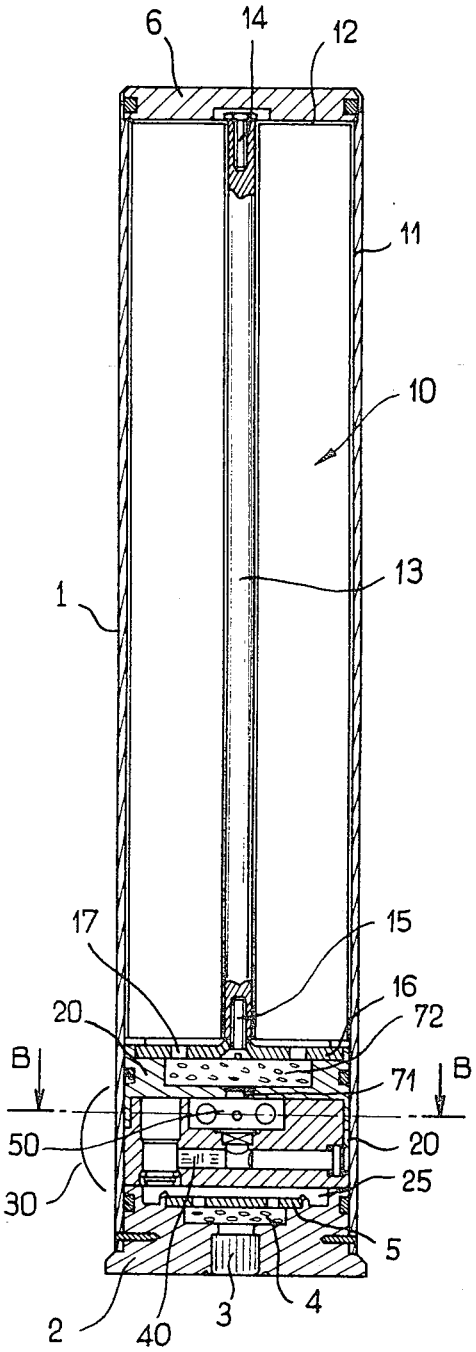
FIG. 1 is a sectional view of a preferred embodiment of a cartridge according to the present invention.
Figure 2:
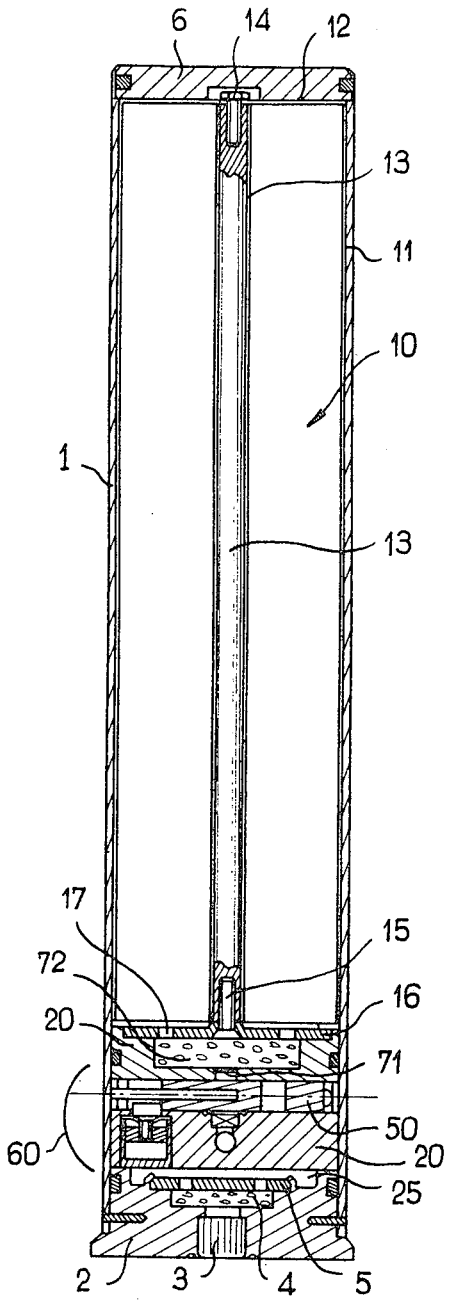
FIG. 2 is another sectional view in a plane perpendicular to that of FIG. 1.

The cartridge illustrated in FIGS. 1 and 2 comprises a tube 1 attached to a casing base 2 which houses a pyrotechnical ejection charge 4 capable of being activated by an electric primer 3. As the gas released from the ejection charge 4 passes through the apertures of a mat 5, it propels a projectile indicated generally by the reference numeral 10, which is expelled when the cap 6 closing the end of the tube 1 at the other end of the projectile, is released.

The upper part of the projectile 10 has a covering consisting of a disc 12 and a cylinder 11. This covering is fixed by a screw 14 to the central shaft 13 which at its lower end in turn receives a screw 15 fixing it to the element 16, which is perforated as shown at 17. Any charge may be inserted between the end walls 12 and 17, for example a signal rocket which is lit up by the gas released by an actuating charge 72 and passing through the apertures 17. The plate 16 is fixed to the base of the projectile, which is indicated by the general reference 20, and may be made in one or several connected pieces.

Figure 4:
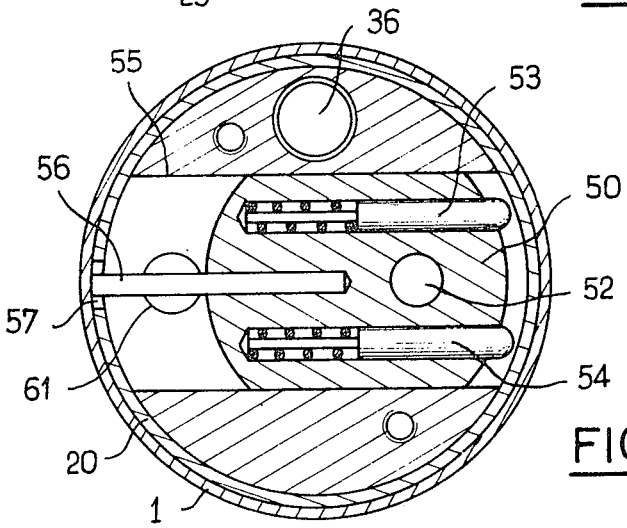
FIG. 4 is a view on an enlarged scale, taken on the line B—B of FIG. 1, looking in the direction of the arrows.
Figure 5:
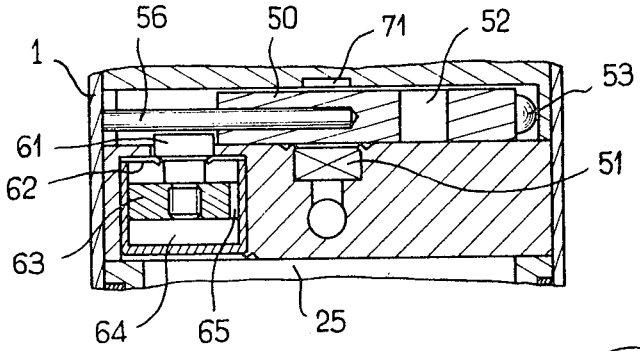
FIG. 5 is a fragmentary detailed view on an enlarged scale to illustrate more clearly the details of the portion of the device generally indicated in FIG. 2 by the reference numeral 60.

As shown in FIGS. 2 and 4, this base has a sliding valve element 50 in the middle portion. The valve has bores containing pins 53 and 54 which are urged outwards to bear against the external wall of the member 20. At its other end, the valve 50 has a rod 56 projecting outwards and extending through an aperture 57 in the member 20 so as to bear against the tube 1. It is obvious that when the projectile leaves the tube, the valve 50 will move to the left in FIG. 4 to abut against the wall 20. The orifice 52 is thereby brought into alignment so that an ignition relay is possible between the relay charge 51 of FIG. 5 and the aforesaid activating charge 72 through a thin plate 71.

The safety elements according to the invention will now be described.

Figure 3:
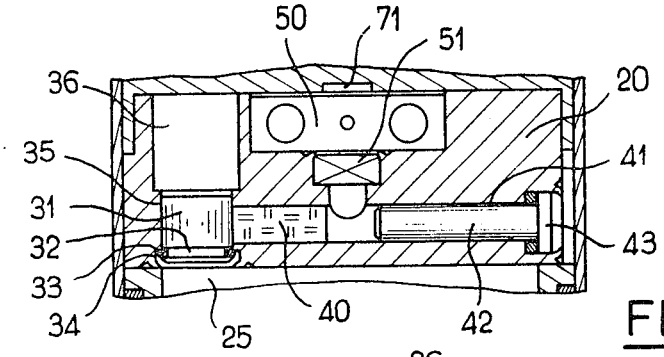
FIG. 3 is a fragmentary detailed view, on an enlarged scale, of a portion of FIG. 1 to illustrate more clearly the elements generally indicated by the reference numeral 30.

Taking the elements of the pyrotechnical chain in order, the first of these safety elements is the one previously referrred to as "the other chain breaker". FIG. 3 shows the upper part of the chamber 25 provided for the expansion of the gas released by the ejection charge 4 and entering through the orifices of the element 5. The pressure in the chamber 25 increases as a result of the expansion of gas and, before it reaches a value sufficient to displace the projectile, it will have acted on the assembly generally indicated by 30, consisting of a sealing-block 31 having a shoulder recess 32 housing a toroidal seal 33 which bears against the lower edge of a bore 35. When the pressure in the chamber 25 exerts sufficient force on the lower surface of the sealing-block 31, the seal 33 enters the bore. the block 31 is thereby driven upwards and may be received in a cavity 36 provided for this purpose. When it has passed above the upper edge of the bore 35, the seal 33 will prevent the sealing-block 31 from descending.

The gas released by the ejection charge not only ensures ejection of the projectile but also ignites a pyrotechnical charge 40 forming a delay relay. This charge 40 is situated in a radial bore adjoining the side of the bore 35 containing the sealing-block 31. This radial bore extends as far as an axial opening providing access to yet another charge constituting an ignition relay 51.

For technological reasons, the radial bore containing the element 40 extends to the other end of the unit 20 by means of another bore 41. The main purpose of this other bore is to accomodate and pack in the delayed action composition 41. After construction the bore 41 is closed by a piston 42 which is connected to a head 43 with interposition of a sealing joint.

The relay charge 51 is directly below the slide valve 50, thereby ensuring ignition relay, provided the valve 50 has meanwhile been able to move to bring the orifice 52 into the axial position after the projectile has left the tube. It will be noted that in fact the relay composition 51 may be ignited at any desired moment since it is situated after the delayed action charge 40.

Figure 5A:
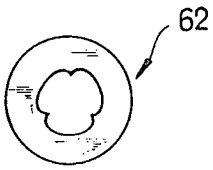
FIG. 5A illustrates in more detail a top plan view of the element 62 of FIG. 5.

Referring back now to the moment of firing of the shot, the gas released by the ejection charge very rapidly imparts a powerful acceleration to the projectile. This acceleration is transmitted to the inertia block 63 of FIG. 5, which is free to slide in a cavity 64, any piston effect being eliminated by an orifice 65 perforating the inertia block 63. It should be understood, however, that if, on the contrary, it is desired to slow down the movement of the inertia block in order to obtain an acceleration over a certain length of time, this could be achieved by adjusting the orifice 65 to a suitable size. This inertia block 63 is thus subjected to a downwardly directed force which is proportional to the acceleration imparted on the projectile and to its mass. A stop 61 screwed to the inertia block 63 extends into the housing of the valve 50 to hold the latter in the chain breaking position. The stop 61 is held in the position for blocking the valve by a washer 62 which, as shown in more detail in FIG. 5A, is a toothed washer. This washer opens when the force exerted on it by the stop 61 reaches a predetermined threshold and consequently when the acceleration transmitted to the parts 61 and 63 reaches a predetermined value. Once the stop has reentered the space provided by the cavity 64, it cannot leave again, and the valve 50 is therefore free to move into the ignition relay position.

The general mode of operation of the cartridge according to the invention may now be described. After activation of the primer 3, the ejection charge 4 begins to burn and produces a vigorous release of gas into the chamber 25. As the pressure rises, the sealingblock 31 of FIG. 3 is displaced upwards, enabling the delayed action charge 40 to ignite, which then burns for a predetermined length of time, for example 5/100ths of a second. At the same time or slightly later, the projectile 10 begins to move. Its acceleration very rapidly reaches a very high value, sufficient to displace the stop in contact with the toothed washer 62 and thereby release the valve, which can thus move into the axial position as soon as the stop has moved out of the way, thereby enabling an ignition relay to be established between the relay charge 51 and the actuating charge 72.

Slightly after the movement of the valve, the delayed action pyrotechnic 40 reaches the end of its combustion and lights up the relay charge 51 which now in turn ignites the actuating charge 72. This charge 72 may in turn not only expel the cartridge charge but also ignite the illuminating rocket or similar charge which it may contain.

The man in the art will appreciate that the charge according to the invention has a very high safety factor. Its safety comes into play also in the event of violent shocks imparted to the cartridge, since displacement of the sealing-block 31 takes place in the axial direction but in the opposite sense to the axial movement required of the inertia block 63 to ensure an ignition relay. Consequently, a violent vertical shock could at the most displace one of these two elements but never both. Furthermore, these parts are situated close to axial planes of the cartridge which are perpendicular to one another.

In one particular embodiment, the toroidal seal 33 of FIG. 3 is a silicone seal for low temperature, which has the advantage of ensuring efficient sealing of the sealing-block when the latter is not displaced. As a result, the displacement of the sealing-block 31 is almost irreversible except by the powerful accelerations which may occur at the firing of the shot.

The cartridge according to the present invention is advantageously applicable as infra red window for aircraft since it provides a very high level of safety even if the delay action of 40 is very brief, so that the infra red window will be deployed very quickly after the projectile has left the aircraft, a condition which the main in the art will recognise as highly desirable.

It should be understood that the present invention is not limited to the embodiment described but extends to any variation conforming to the spirit of the invention.

We claim:

1. A cartridge having pyrotechnical actuation of a payload, comprising a tube attached to a generally cylindrical casing base, and a projectile equipped with a delayed action pyrotechnical chain and an actuating charge mounted in said base, and an ejection charge in said base intermediate said base and said projectile, wherein the pyrotechnical chain is activated by the ejection charge so as to ignite the actuating charge after the projectile has left the tube, and wherein the pyrotechnical chain is broken at a valve member that is slidable transversely relative to the axis of said cartridge, which member is movable into an operative position for ignition relay until after the projectile has left the tube, and wherein the said valve member is held in the chain breaking postiion by a stop member which is attached to an inertia block that is axially immobile until a predetermined inertial force intensity has been applied, said inertia block then being axially movable to displace the stop under the effect of the acceleration of said projectile due to the firing of the projectile, and wherein said pyrotechnical chain comprises another, second chain breaker comprising a sealing-block which is disposed to break said chain and which is axially immobile below a predetermined force applied by firing of said ejection charge to generate combustion gas, and wherein said sealing block is axially movable to a position in which it does not break the chain under pressure applied by said combustion gas.

2. A cartridge according to claim 1, wherein said second chain breaker is situated in said projectile between the ejection charge and the beginning of the delayed action pyrotechnical chain.

3. A cartridge according to claim 2, wherein said sealing-block is slidable in a bore and has a shoulder seating a toroidal seal which is larger than said bore and abuts against the bore with the sealing-block in the chain breaking position, and wherein the said sealing block is axially movable in said bore with its seal, in response to pressure applied by the combustion gas.

4. A cartridge according to claim 1 wherein said stop is held in the position for immobilizing the valve by a toothed washer which yields under a predetermined force.

5. A cartridge according to claim 1 wherein the pressure of the combustion gas on said sealing-block displaces said sealing block axially in the opposite direction to the axial direction in which said inertia block is movable upon acceleration produced by the firing of said ejection charge.

6. A cartridge according to claim 5 wherein the inertia block and the sealing-block are disposed for axial movement along paths respectively that are angularly spaced from each other about the axis of said projectile.

7. In a cartridge having a tubular casing, a projectile portion and a payload in said projectile portion, an ejection charge for the payload, and a delayed action pyrotechnic chain for ignition of an actuating charge of the projectile portion, said delayed action chain including a transversely slidable valve member that is interposed in said train to obstruct it, said valve member being slidable transversely of said projectile portion upon ejection of said projectile portion from the casing to remove the obstruction, the improvement comprising, in combination:

a pair of independently operable means each obstructing said chain, but each being axially movable, in opposite directions relative to each other, to remove said obstructions, a first of said means comprising a sealing plug that is axially movable under pressure of the combustion gas produced upon ignition of the ejection charge, in the direction of movement of the projectile portion relative to the casing, to be displaced and to remove its obstruction of said delayed action chain, and a second of said means comprising an inertia block, said inertia block being disposed normally to prevent transverse movement of said transversely slidable valve member, said inertia block being axially movable relative to said projectile portion in an axial direction opposite to that of the direction of movement of the projectile portion relative to the casing, upon ejection of the projectile portion from the case, and when so moved, to permit transverse movement of said transversely slidable valve member.

8. A cartridge according to claim 7, further comprising means for retaining each of said means, independently of each other, in its axially moved position respectively.

9. A cartridge according to claim 7 wherein the axis of axial movement of each of said means falls in two planes that each include the axis of said casing respectively, and which planes are angularly spaced relative to each other.

* * * * *